US008164554B2

(12) United States Patent
Takaki

(10) Patent No.: US 8,164,554 B2
(45) Date of Patent: Apr. 24, 2012

(54) LIQUID CRYSTAL DISPLAY

(75) Inventor: Jiro Takaki, Kumamoto (JP)

(73) Assignee: Mitsubishi Electric Corporation, Tokyo (JP)

( * ) Notice: Subject to any disclaimer, the term of this patent is extended or adjusted under 35 U.S.C. 154(b) by 558 days.

(21) Appl. No.: 12/388,054

(22) Filed: Feb. 18, 2009

(65) Prior Publication Data

US 2009/0267881 A1 Oct. 29, 2009

(30) Foreign Application Priority Data

Feb. 20, 2008 (JP) ..... 2008-038427

(51) Int. Cl.
*G09G 3/36* (2006.01)

(52) U.S. Cl. ..... 345/89; 345/690

(58) Field of Classification Search ..... 345/87, 345/89, 690, 90, 100, 102
See application file for complete search history.

(56) References Cited

U.S. PATENT DOCUMENTS

| | | | | |
|---|---|---|---|---|
| 6,466,225 | B1 | 10/2002 | Larkin et al. | |
| 2004/0263462 | A1 * | 12/2004 | Igarashi | 345/98 |
| 2005/0162360 | A1 | 7/2005 | Ishihara et al. | |

FOREIGN PATENT DOCUMENTS

| | | |
|---|---|---|
| JP | 2000-29442 | 1/2000 |
| JP | 2001-296841 | 10/2001 |
| JP | 2006-178488 | 7/2006 |

* cited by examiner

*Primary Examiner* — Quan-Zhen Wang
*Assistant Examiner* — Calvin C Ma
(74) *Attorney, Agent, or Firm* — Oblon, Spivak, McClelland, Maier & Neustadt, L.L.P.

(57) ABSTRACT

A data converter divides input data into first subframe data and latter subframe data, and the latter subframe data is given to a data serial-parallel converter and serial-parallel converted. The first subframe data is given to a line memory group, and given to an overdrive operation circuit after a given delay. The latter subframe data converted into parallel data is given to a line memory group, and given to a data parallel-serial converter after a given delay, where it is parallel-serial converted, and then it becomes output data after the first subframe data outputted from the overdrive operation circuit.

8 Claims, 9 Drawing Sheets

LIQUID CRYSTAL DISPLAY

BACKGROUND OF THE INVENTION

1. Field of the Invention

The present invention relates to liquid crystal displays, and particularly to a liquid crystal display that adopts a hold-type display scheme.

2. Description of the Background Art

In liquid crystal displays, tailing and after image may occur in the displayed moving images. When such troubles are due to the response time of the liquid crystals, there are known methods that improve the response time of the liquid crystal panel, or that use the overdrive function. In the overdrive function, when the gray level of the moving picture displayed on the liquid crystal panel does not achieve the target gray level, the voltage applied to the liquid crystal panel is temporarily raised to compensate for the lack of the applied voltage, so as to achieve the target gray level.

It is thus possible to achieve the target brightness within one frame by applying these methods, but the so-called hold-type display scheme has a peculiar problem that the boundaries of objects appear blurred when displaying moving images, because it provides no dark display between frames like the impulse-type display scheme.

Pseudo-impulse driving schemes have been developed in order to solve the problem, including a scheme called black frame insertion (black writing) where black images are inserted between frames, as illustrated for example in FIG. 50 of Japanese Patent Application Laid-Open No. 2006-178488 (which is hereinafter referred to as Patent Document 1), and a scheme where backlight brightness is controlled to insert black display periods.

However, while adopting the black frame insertion (black writing) scheme improves the display of moving images, inserting black of the minimum brightness between frames reduces the brightness in the entire screen.

There is a method that increases backlight brightness to solve the reduction of brightness, but it leads to problems such as increased power consumption and increased black brightness.

For techniques that adopt the black frame insertion (black writing) while suppressing the reduction of brightness, Patent Document 1 and Japanese Patent Application Laid-Open No. 2001-296841 (which is hereinafter referred to as Patent Document 2), for example, disclose methods in which black is written when the input data is below a defined value, and white or a color of a gray level close to white is written when the input data exceeds the defined value.

Also, Japanese Patent Application Laid-Open No. 2000-029442 (hereinafter referred to as Patent Document 3) discloses a method in which an extreme value (white or black) and a halftone are displayed in alternate frames to display the same gray level as the input data.

In this way, for the problem of image blur in displaying moving images, which is peculiar to the hold-type display scheme, various attempts have been made to solve the problem with no reduction in brightness, no increase in power consumption, and with no increase in black brightness, but such attempts involved problems leading to increased costs, such as increased circuit scale, need for increased frame memory capacity, and need for higher-speed communication with the frame memory.

SUMMARY OF THE INVENTION

A liquid crystal displays adopting a hold-type display scheme is provided which solves image blur in displaying moving images, with no reduction in brightness, no increase in power consumption and no increase in black brightness, while keeping costs low.

A liquid crystal displays according to an aspect of the present invention includes a liquid crystal panel, a controller that controls display in the liquid crystal panel on the basis of input frame data, and a frame memory that stores, frame by frame, data displayed in the liquid crystal panel. The controller includes: a data converter that divides the input frame data into first subframe data and latter subframe data, and that makes settings such that an average of integrated values of output brightness of the first subframe and output brightness of the latter subframe is equal to a target brightness of the input data; and a data serial-parallel converter that serial-parallel converts the latter subframe data. The latter subframe data is created in the data converter to include four pieces of data including maximum output brightness data, minimum output brightness data, and arbitrary first and second brightness data that are respectively close to the maximum output brightness data and the minimum output brightness data, and the latter subframe data is stored in the frame memory, and the first subframe data is used to control the display in the liquid crystal panel together with latter subframe data that is stored in the frame memory for one horizontal line that precedes the currently-processed one horizontal line by a predetermined number of lines.

The liquid crystal displays described above divides input frame data into first subframe data and latter subframe data, and makes settings such that an average of integrated values of the output brightness of the first subframe and the output brightness of the latter subframe is equal to the target brightness of the input data, and the latter subframe data is created such that it includes four pieces of data including maximum output brightness data, minimum output brightness data, and arbitrary first and second brightness data respectively close to them, whereby image blur in displaying moving images is suppressed in a liquid crystal displays adopting a hold-type display scheme. Also, the reduction of brightness in the entire screen is suppressed by the use of the arbitrary brightness data respectively close to the maximum output brightness data and the minimum output brightness data as latter subframe data, together with the maximum output brightness data and the minimum output brightness data. Accordingly, there is no need to increase backlight brightness to deal with the reduction of brightness, and so the power consumption is not increased and the black brightness is not increased. Also, the conventional configuration can be used to obtain the effects above without a need to add special configuration to the liquid crystal displays, and so the circuit scale is not enlarged. Also, there is no need for increased frame memory capacity and higher-speed communication with the frame memory, and so no cost increase is needed.

These and other objects, features, aspects and advantages of the present invention will become more apparent from the following detailed description of the present invention when taken in conjunction with the accompanying drawings.

DESCRIPTION OF THE PREFERRED EMBODIMENTS

Prior Information

Prior to the description of the present invention, a problem peculiar to the hold-type display scheme, i.e. image blur in displaying moving images, will be described referring to FIGS. 1 to 7.

Figure 1:
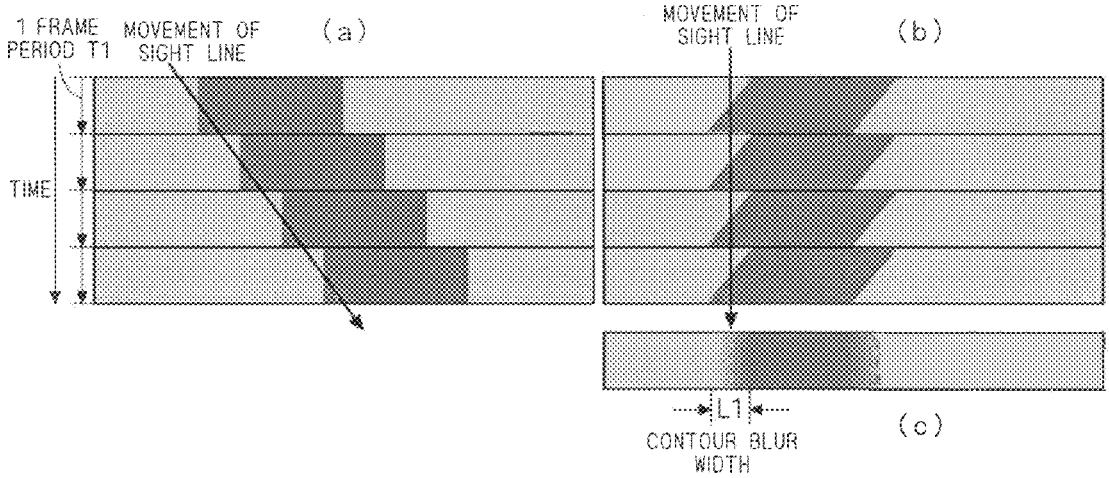
FIG. 1 is a diagram illustrating the display of a moving image according to a hold-type display scheme.

FIG. 1 is a diagram illustrating the display of images in which an object moves horizontally on a still background in a hold-type image display apparatus that does not adopt the black frame insertion scheme, where the variation of brightness on one horizontal line in the screen is shown with the passage of time. In (a) and (b) portions of FIG. 1, the horizontal axis shows the state of brightness in the horizontal direction on the screen, and the vertical axis shows the passage of time, and FIG. 1 illustrates the display on the screen for four frame periods, with one frame period shown as T1.

(a) portion of FIG. 1 shows the movement of the line of sight that is exhibited when the viewer's line of sight follows the image of the horizontally moving object, and (b) portion of FIG. 1 shows the movement of the line of sight and the variation of brightness that are exhibited when the object appears substantially still as the viewer's line of sight moves. Also, (c) portion of FIG. 1 shows the distribution of brightness of the object that is viewed by the viewer viewing the moving object, where gradations are occurring at the contours of the moving object and the contours appear blurred. The width of blur is shown as L1.

Figure 2:
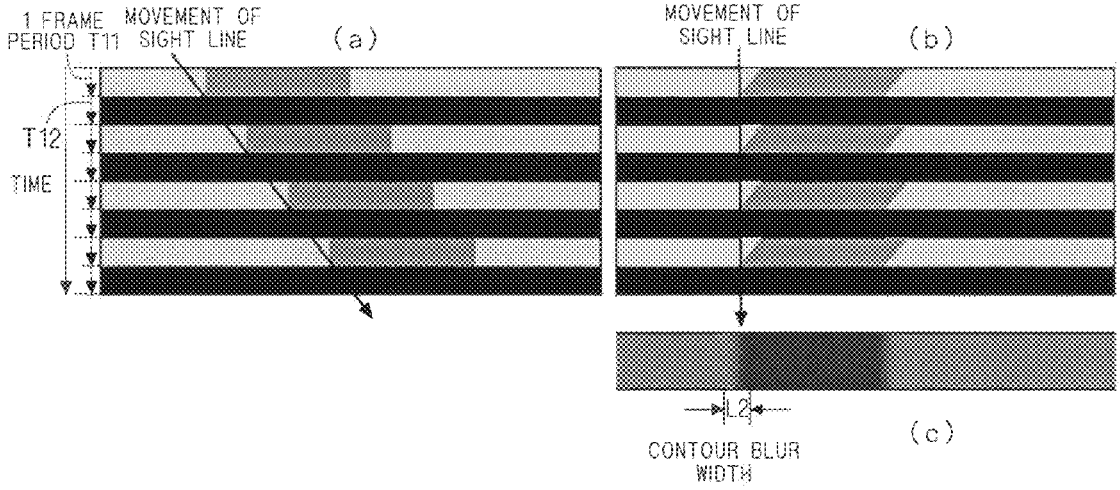
FIG. 2 is a diagram illustrating the display of a moving image according to a hold-type display scheme.

FIG. 2 is a diagram illustrating the display of a horizontally moving object in a hold-type image display apparatus that adopts the black frame insertion scheme, where the variation of brightness on one horizontal line in the screen is shown with the passage of time. In (a) and (b) portions of FIG. 2, the horizontal axis shows the state of brightness in the horizontal direction on the screen, and the vertical axis shows the passage of time, where one frame period T1 is divided into two subframe periods T11 and T12, and black images are displayed in the subframe periods T12. Also, (c) portion of FIG. 2 shows the distribution of brightness of the object that is viewed by the viewer viewing the moving object, where gradations are occurring at the contours of the moving object but the blur width L2 is considerably narrower than the blur width L1 shown in (c) portion of FIG. 1.

As described before, Patent Document 2 discloses, in Paragraphs 0155 and 0156, a technique for suppressing the reduction of brightness while adopting the black frame insertion (black writing), where a defined value is determined for the input data, and black is written when the data is below the defined value, and white or a color of a gray level close to white is written when the defined value is exceeded, and where the border is set at 50% gray level of the input data.

Figure 3:
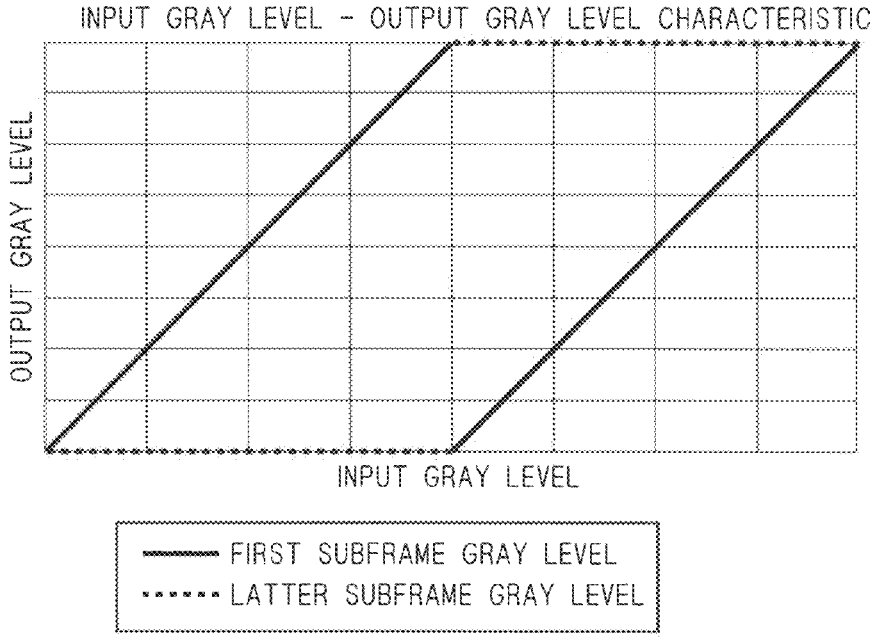
FIG. 3 is a diagram illustrating a gray-level characteristic between input gray level and output gray level.

FIG. 3 shows a gray level characteristic between the input gray level and output gray level that is exhibited when data is outputted for each subframe across a border at 50% gray level of the input data. In FIG. 3, the horizontal axis shows the input gray level and the vertical axis shows the output gray level, and the diagram shows that data is outputted for the latter subframe when the gray level of the input data becomes 50%.

Figure 4:
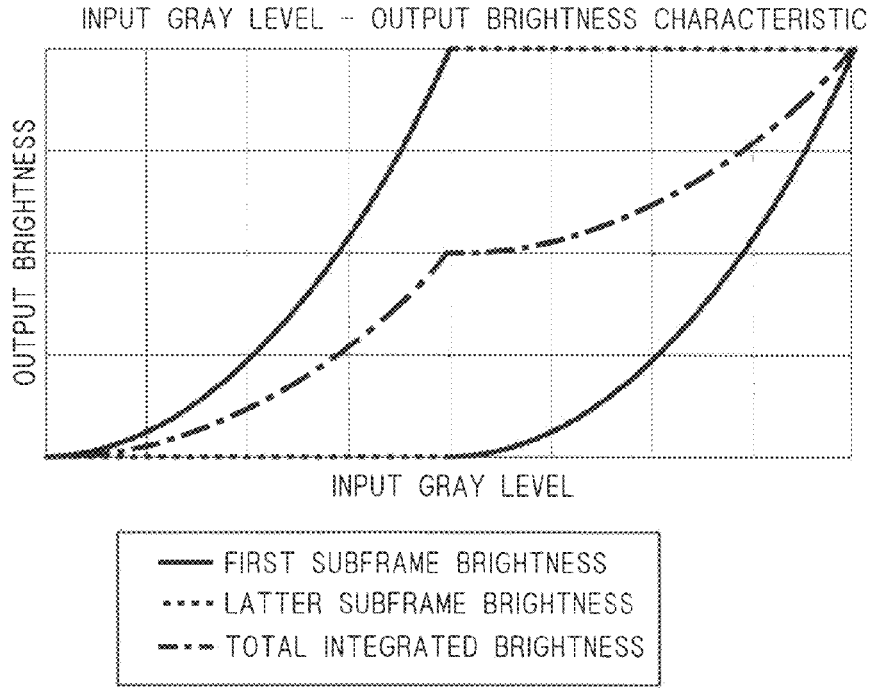
FIG. 4 is a diagram illustrating a characteristic between input gray level and output brightness.

Making the judgment based on the gray level presents no problem when the γ brightness characteristic is 1; however, the relation with the output brightness is shifted when the γ characteristic is not 1, and then the target gray level characteristic cannot be obtained as shown in FIG. 4 that illustrates the characteristic between the input gray level and the output brightness. That is, in FIG. 4, the horizontal axis shows the input gray level and the vertical axis shows the output brightness, together with the total integrated brightness, and the γ characteristic represented by the total integrated brightness is shifted from the exponential function characteristic as an ideal γ characteristic.

Figure 5:
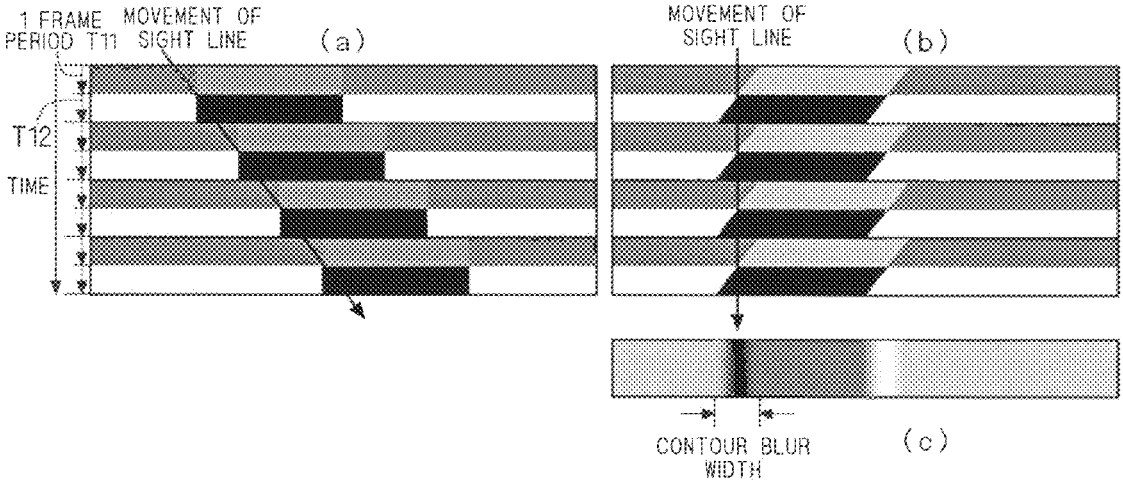
FIG. 5 is a diagram illustrating the display of a moving image according to a hold-type display scheme.

Also, when the gray level varies across the defined value at 50% from a lower gray level to a higher gray level, or from a higher gray level to a lower gray level, a dark line and a bright line occur at the contours of the gray level variation. FIG. 5 show the variation of brightness on one horizontal line in the screen in that case, with the passage of time. In (a) and (b) portions of FIG. 5, the horizontal axis shows the state of brightness in the horizontal direction on the screen, and the vertical axis shows the passage of time, where one frame period T1 is divided into two subframe periods T11 and T12, and black images are displayed in the subframe periods T12. Also, (c) portion of FIG. 5 shows the distribution of brightness of the moving object when viewed by a viewer viewing the moving object, where gradations are occurring at the contours of the moving object, and the state of blur in the direction of movement of the moving object and the state of blur in the opposite direction differ from each other.

That is, the image is blurred with a bright line at the contour on the side of the movement of the moving object, and it is blurred with a dark line at the contour on the side opposite to the direction of movement.

Figure 6:
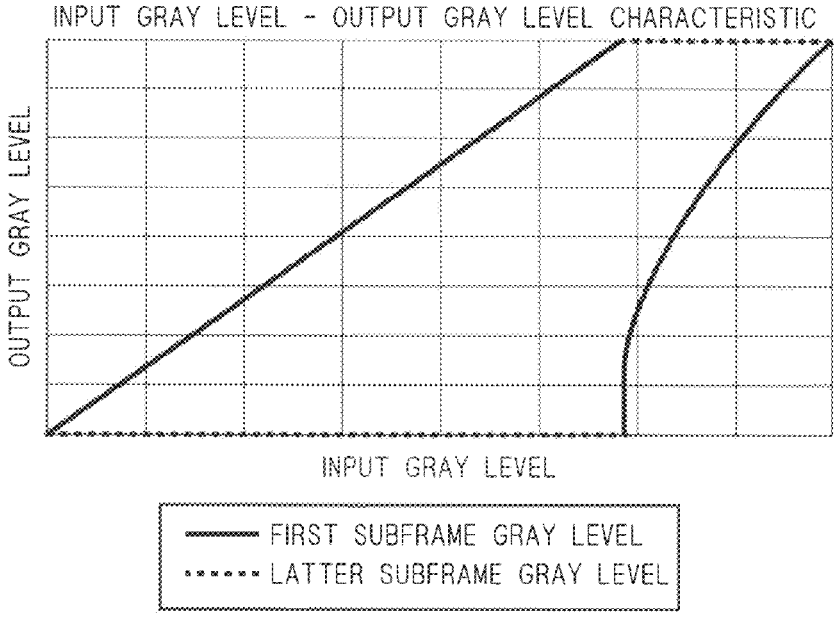
FIG. 6 is a diagram illustrating a gray-level characteristic between input gray level and output gray level.
Figure 7:
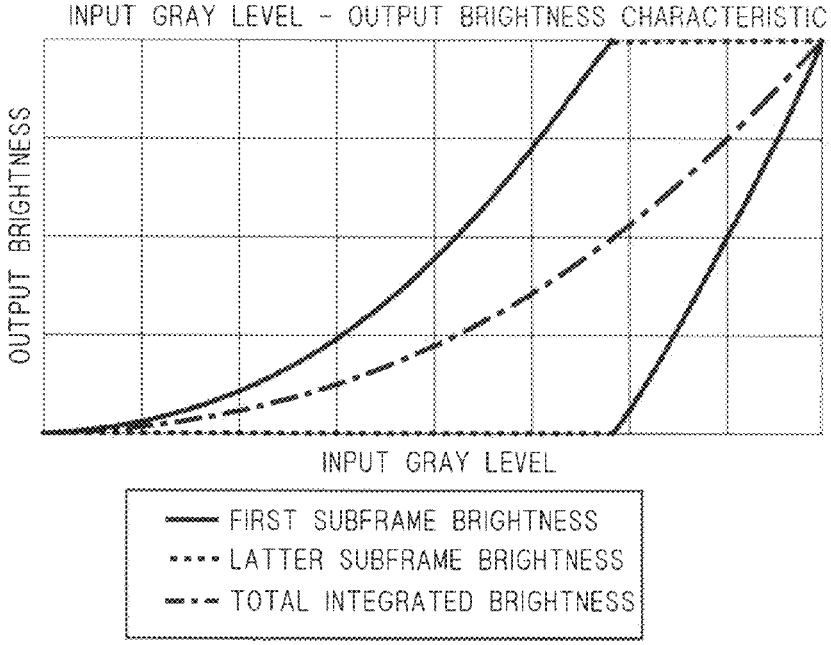
FIG. 7 is a diagram illustrating a characteristic between input gray level and output brightness.

In Patent Document 3, as mentioned above, an extreme value (white or black) and a halftone are displayed in alternate frames to display the same gray level as the input data. FIG. 6 shows the gray level characteristic between the input gray level and the output gray level in this case, and FIG. 7 shows the output brightness characteristic.

With such characteristics, when a gray-level pattern is displayed, for example, flicker is visually recognized at the border of 50% brightness level. This is because, the display of data of 50% brightness level and data of 51% are 100/0 (50%) in the first/latter subframe period and 2/100 (51%) in the first/latter subframe period, and thus the amplitude of brightness is large between adjacent pixels. Accordingly, noticeable flicker appears with a pattern such as a checker flag.

First Preferred Embodiment

Now, a liquid crystal display according to a first preferred embodiment of the present invention will be described referring to FIGS. 8 to 14.

<Configuration of Apparatus>

Figure 8:
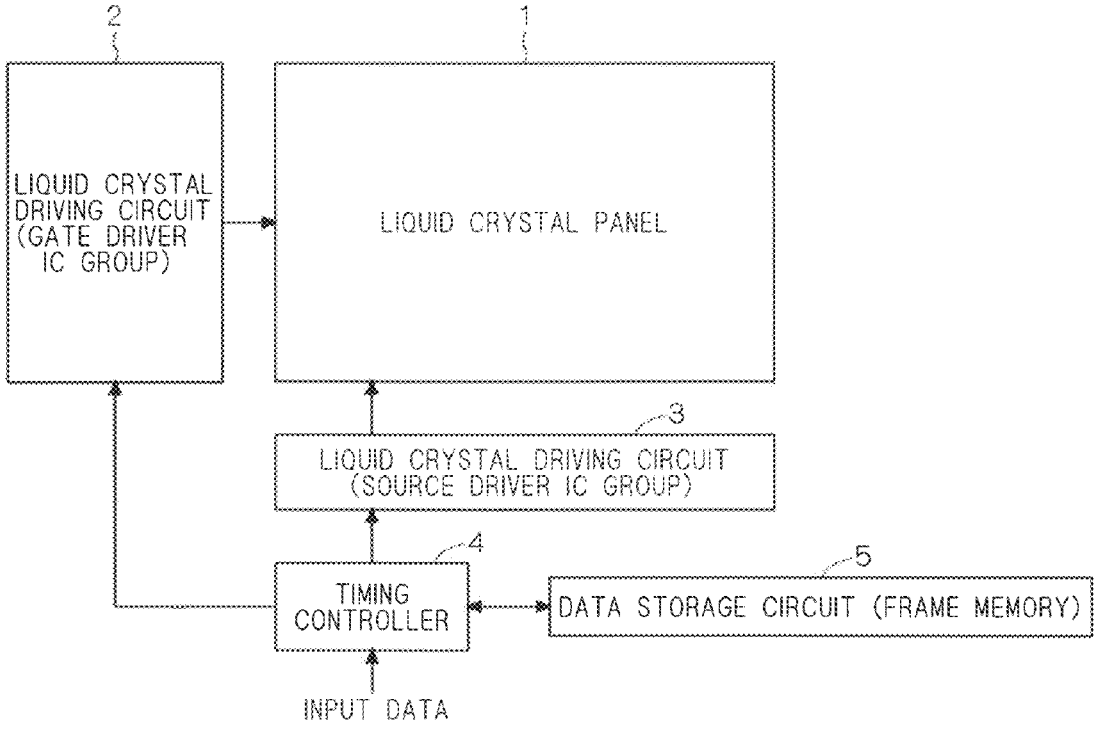
FIG. 8 is a block diagram illustrating the circuit configuration of the entirety of a liquid crystal displays according to a first preferred embodiment of the present invention.

FIG. 8 is a block diagram illustrating the circuit configuration of the entire liquid crystal display of the first preferred embodiment. As shown in FIG. 8, it includes a liquid crystal driving circuit (gate driver IC group) 2 for giving signals to the gate electrodes arranged in parallel to the longer sides of a rectangular liquid crystal panel 1, and a liquid crystal driving circuit (source driver IC group) 3 for giving signals to the source electrodes arranged in parallel to the shorter sides of the rectangular liquid crystal panel 1. A timing controller 4 is connected to the liquid crystal driving circuit 2 and the liquid crystal driving circuit 3 to control the liquid crystal driving circuit 2 and the liquid crystal driving circuit 3 on the basis of signal information from a data storage circuit (frame memory) 5.

Figure 9:
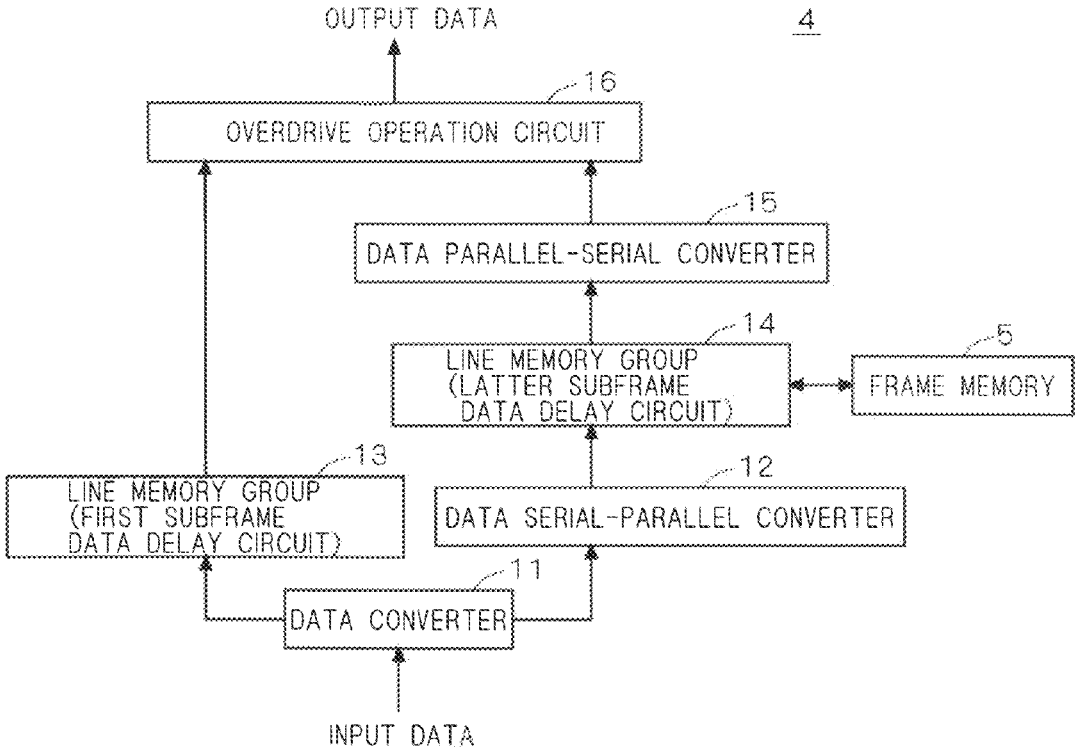
FIG. 9 is a block diagram illustrating the configuration of a timing controller.

FIG. 9 is a block diagram illustrating the configuration of the timing controller 4, which includes a data converter 11, a data serial-parallel converter 12, a line memory group 13 constituting a first-subframe-data delay circuit, a line memory group 14 constituting a latter-subframe-data delay circuit, a data parallel-serial converter 15, and an overdrive operation circuit 16.

The data converter 11 divides the input frame data (input data) into first subframe data and latter subframe data, and the latter subframe data is given to the data serial-parallel converter 12 where it is serial-parallel converted. The first subframe data is given to the line memory group 13, and given to the overdrive operation circuit 16 after a given delay.

The latter subframe data converted into parallel data is given to the line memory group 14, and given to the data parallel-serial converter 15 after a given delay, where it is parallel-serial converted, and it becomes output data after the first subframe data outputted from the overdrive operation circuit 16.

Figure 10:
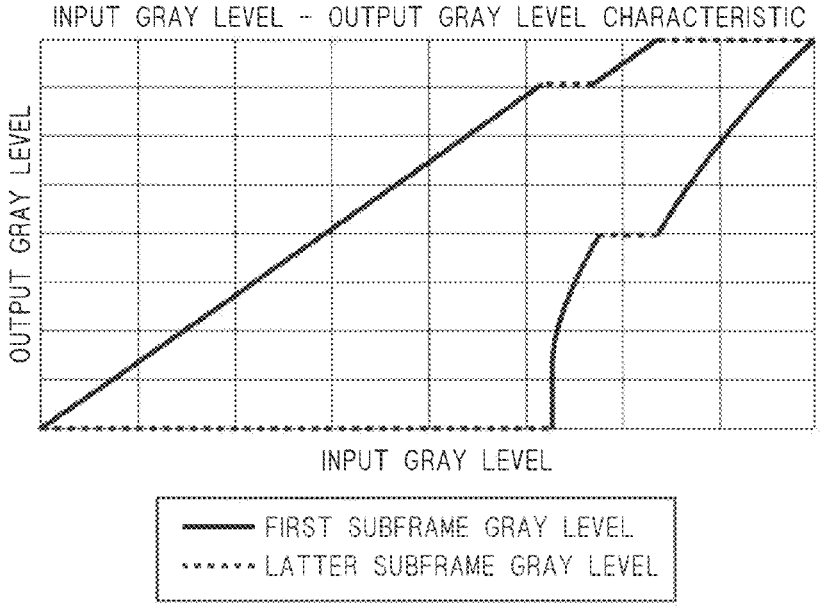
FIG. 10 is a diagram illustrating the gray-level characteristic between input gray level and output gray level in the liquid crystal display of the first preferred embodiment of the present invention.
Figure 11:
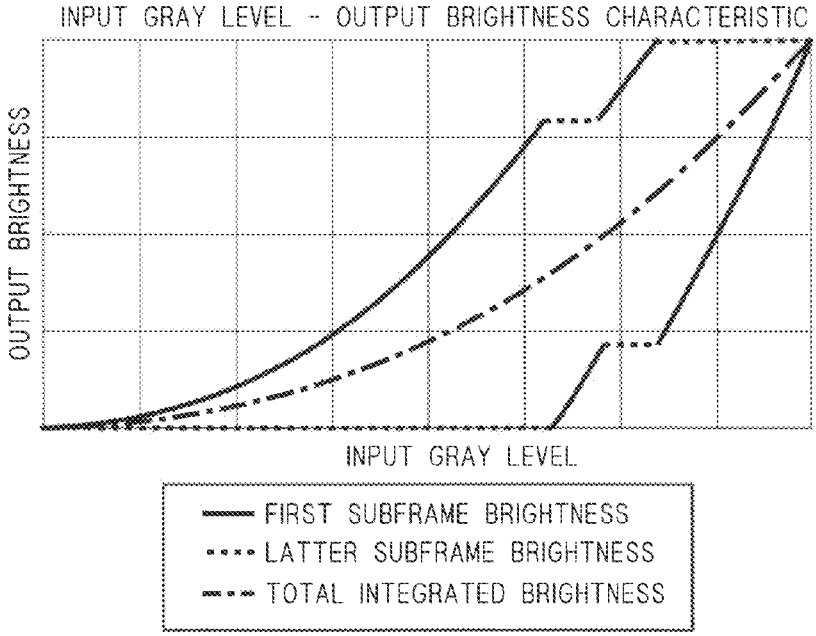
FIG. 11 is a diagram illustrating the characteristic between input gray level and output brightness in the liquid crystal display of the first preferred embodiment of the present invention.

FIG. 10 shows an example of the gray level characteristic between the input gray level (input data) and the output gray level (output data) when control is provided by the timing controller 4 shown in FIG. 9, and FIG. 11 shows the input gray level and output brightness characteristic in that case.

For the data conversion of input gray level to output gray level, the data converter 11 divides the input data into first subframe data and latter subframe data, and the conversion can be obtained by calculation based on formulas obtained from the γ brightness characteristic, or the conversion may be achieved by using a previously created lookup table (LUT); means thereof is not restricted. Also, the LUT can be obtained by reading from the outside by using an external ROM (Read Only Memory) or communication means.

As shown in FIG. 11, the latter subframe data means data of white and black, and arbitrary data close to white and black. That is, in FIG. 11, the data of the maximum output brightness is the white data, the data of the minimum output brightness is the black data, the data of a brightness somewhat lower than the maximum output brightness is the arbitrary data close to white, and the data of a brightness somewhat higher than the minimum output brightness is the arbitrary data close to black. Accordingly, the data is handled as 2-bit data regardless of the gray-level bit width of the input data. For example, 00=Gray level 0, 01=Gray level 158, 10=Gray level 186, and 11=Gray level 256.

Thus, there is no need to process with the gray-level bits of the input data, and the scale of the circuitry including the data converter 11 can be small.

The first subframe data is determined such that an average of integrated values of the display brightness of the first subframe data and the latter subframe data is equal to a converted value of the display brightness of the input data (target brightness). That is, when the ratios of the display times of first/latter subframes are 50% and 50% and the transition time of the output brightness is 0, and the target output brightness is 10%, then 20% brightness is outputted for the first subframe and 0% brightness is outputted for the latter subframe, so that the output brightness is (20+0)/2=10%. When the transition time has a finite value, (20+α) % brightness is outputted for the first subframe and 0% brightness is outputted for the latter subframe.

With this ruling scheme, the latter subframe is 0% brightness (black) when the target output brightness of the input data is less than 50%, and the output brightness of the first subframe is high. However, when the target output brightness of the input data is above 50%, the latter subframe is 100% brightness (white) and the output brightness of the first subframe is low. The description above has been made assuming that the first subframe and the latter subframe have display times at equal ratios, but the ratios may be varied, for example as the first 35% and the latter 65%.

<Operation>

Figure 12:
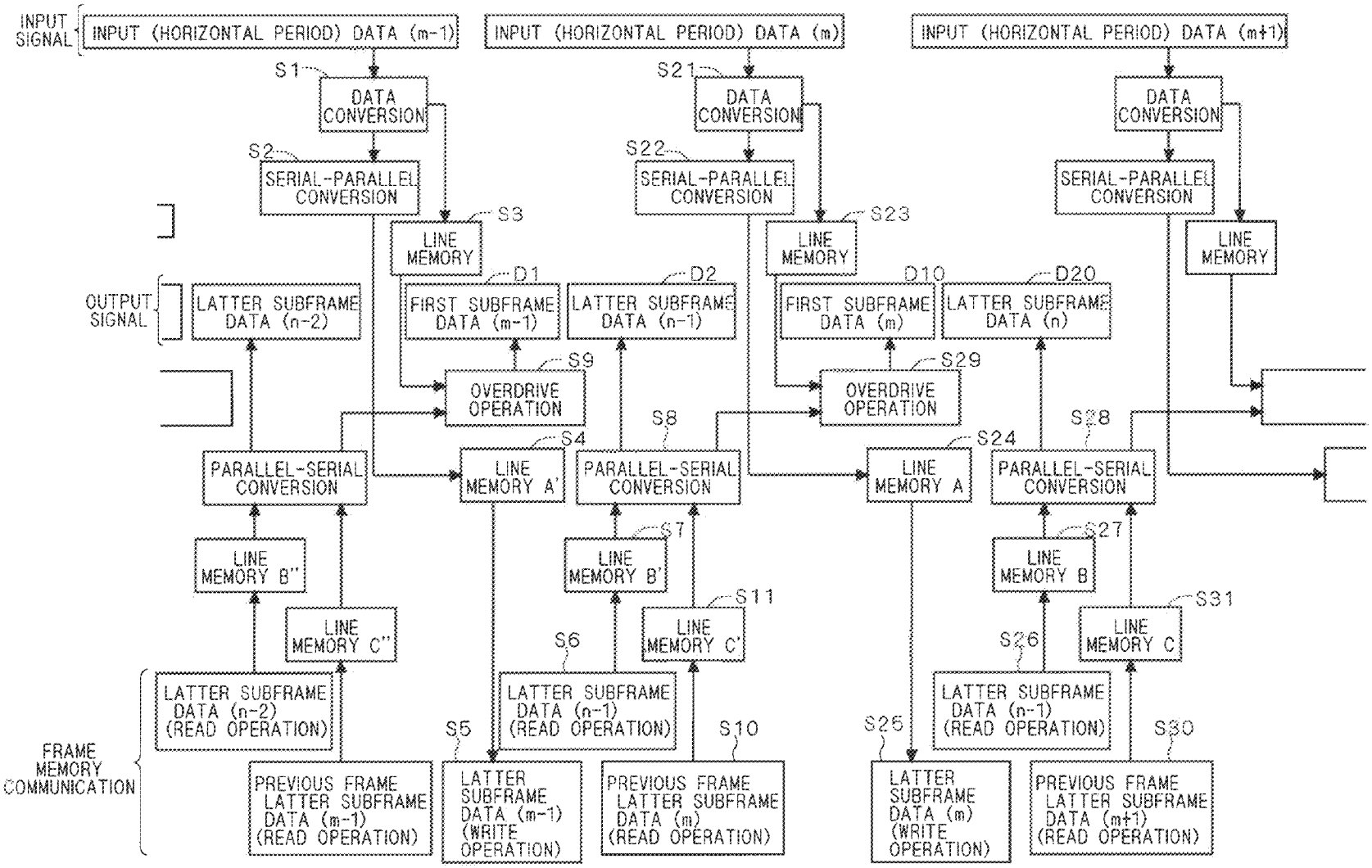
FIG. 12 is a diagram illustrating the data flow in the timing controller.

Now, the operation of the timing controller 4 will be described referring to FIG. 12 illustrating the data flow for the timing controller 4 shown in FIG. 9. FIG. 12 shows a flow about input data at multiple addresses, but the data at address m−1 and the data at address m will be described here. For example, m represents an input signal for the mth horizontal line, and it has a relation of n<m with respect to the nth line described later.

The input data at address m−1 inputted to the data converter 11 is divided into first subframe data and latter subframe data (Step S1).

Then, the latter subframe data is serial-parallel converted in the data serial-parallel converter 12 (Step S2), and given to a line memory A' in the line memory group 14 (Step S4).

On the other hand, the first subframe data is given to the line memory group 13 (Step S3), and given to the overdrive operation circuit 16 after a given delay, where it is subjected to overdrive operation (Step S9).

The latter subframe data given to the line memory A' in the line memory group 14 is stored at address m−1 in the frame memory 5 (Step S5).

On the other hand, the latter subframe data for the (n−1)th line, which is already stored at a different address n−1 in the frame memory 5, is read (Step S6) and given to a line memory B' in the line memory group 14 (Step S7). When the first subframe and the latter subframe have display periods at equal ratios, the address n−1 to be read at this time is an address that precedes the address m−1 by about (one frame period/one horizontal period)/2. For example, when one frame period includes 800 horizontal periods and the address m−1 is 600, then the address n−1 is 200.

This operation is performed because, when one frame period is divided into first and latter subframes and the latter subframe is used as a blanking (black frame insertion) period, and when the writing of the latter subframe is started after the first subframe has been written, then it is not practical since, in one frame period, the blanking period requires lines of the same number as or a larger number than the number of write lines.

The same operation is performed also when the first subframe and the latter subframe have different display period ratios, in which case the coefficient is not ½ (0.5) but it is the display period ratio (1>) of the first subframe.

The latter subframe data for the address n−1 given to the line memory B' in the line memory group 14 undergoes a given delay, and outputted to the data parallel-serial converter 15 and parallel-serial converted (Step S8) from 2-bit data into serial data of a given bit width, and then it becomes output data after the first subframe data for the address m−1 outputted from the overdrive operation circuit 16.

When the first subframe data for the address m−1 is inputted to the overdrive operation circuit 16 in Step S9, the target gray level in one frame can be certainly achieved by inputting the latter subframe data of the previous frame into the overdrive operation circuit 16 as comparative data, making it possible to certainly obtain the effect of overdriving.

Accordingly, in the flow for processing the input data for the address m−1 (not explained here), the latter subframe data of the previous frame, which is stored at the address m−1 in the frame memory 5, is read and written into a line memory C" in the line memory group 14, and subjected to parallel-serial conversion in the data parallel-serial converter 15, and inputted to the overdrive operation circuit 16 in Step S9, with timing matched with the first subframe data for the address m−1 of the present frame. The overdrive operation circuit 16 outputs the overdrive-operated first subframe data D1 for the address m−1.

In the flow for processing the input data of address m, this operation corresponds to: the process of reading the latter subframe data of the previous frame stored at the address m in the frame memory 5 (Step S10); the process of writing the read data into the line memory C' in the line memory group 14 (Step S11); the process of applying parallel-serial conversion in the data parallel-serial converter 15 (Step S8); and the process of inputting the latter subframe data of the address m of the previous frame into the overdrive operation circuit 16 in Step S29 with timing matched with the first subframe data of the address m of the present frame (Step S29).

Accordingly, the amount of delay of the line memory group 13 and the amount of delay of the line memory group 14 are set such that the first subframe data of the present frame and the latter subframe data of the same address of the previous frame are inputted to the overdrive operation circuit 16 in a matched phase.

In the description above, the latter subframe data of the previous frame read from the frame memory 5 undergoes parallel-serial conversion in the data parallel-serial converter 15, and this is an operation that is made so that the overdrive operation circuit 16 having a conventional configuration can be used. The latter subframe data of the previous frame, i.e. four pieces of data of white, black, close to white, and close to black, are restored to a given bit width before they are given to the overdrive operation circuit 16, so that the overdrive operation circuit 16 does not have to perform data change from halftone data to halftone data, and what is needed is only the calculation from the four pieces of data of white, black, close-to-white, and close-to-black into halftone data, requiring no need to enlarge the circuit scale.

In FIG. 12, the operations in Steps S21 to S31 are basically the same as those in Steps S1 to S11. However, the flow for processing the input data of the address m processes the address m for the address m−1 of the present frame, the address n for the address n−1, and the address m for the address m−1 of the previous frame, and the overdrive operation circuit 16 outputs overdrive-operated first subframe data D10 of the address m. Also, line memories A, B and C are used for the line memories A' to C' in the line memory group 14.

Thus, the first subframe data and the latter subframe data are outputted in one horizontal period, and so it is necessary to control the ON periods of the gate electrodes of the liquid crystal panel 8 shown in FIG. 8. That is, when the display periods of the first subframe data and the latter subframe data are at equal ratios, a gate start pulse (STV) is given to the first line and an intermediate line in one frame. However, then the gate ON periods are generated in two places in one frame, and so control is performed so that a gate ON period is generated only in one place in one frame, by using the output enable function (OFFEV) of the gate driver IC. That is, if the gate lines are simultaneously ON in two places, the latter subframe data is written after the first subframe data has been written, and as a result the latter subframe data is written into gate lines in two places. Accordingly, which one of the gate lines in two places is to be turned on is selected, separately for the period in which the first subframe data is outputted and the period in which the latter subframe data is outputted.

EFFECTS

As described so far, the liquid crystal display of the first preferred embodiment of the present invention makes setting such that an average of integrated values of the output brightness of the first subframe and the output brightness of the latter subframe is equal to the target brightness of the input data, and uses four pieces of data including maximum output brightness data, minimum output brightness data, and arbitrary data respectively close to them as the latter subframe data, whereby the image blur in displaying moving images can be suppressed in a liquid crystal display adopting a hold-type display scheme.

Figure 13:
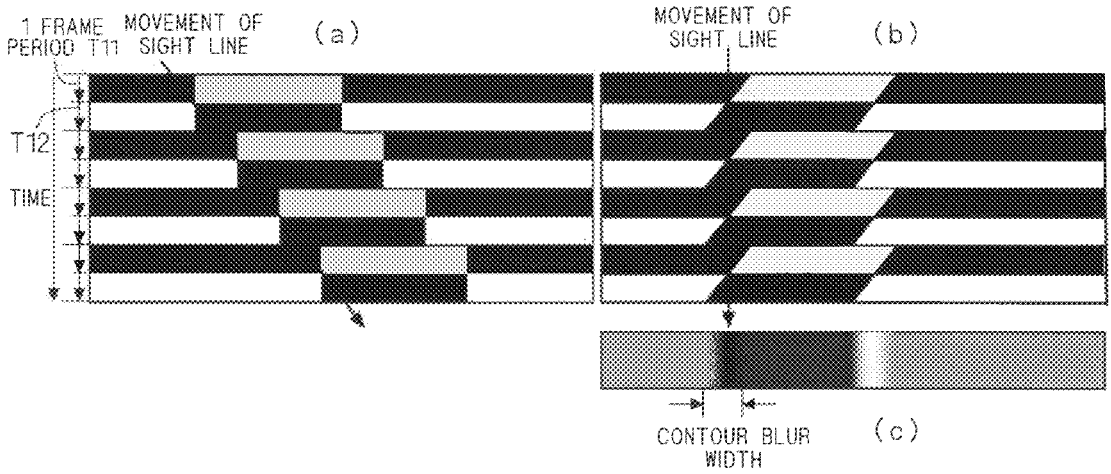
FIG. 13 is a diagram illustrating the display of a moving image according to a hold-type display scheme.
Figure 14:
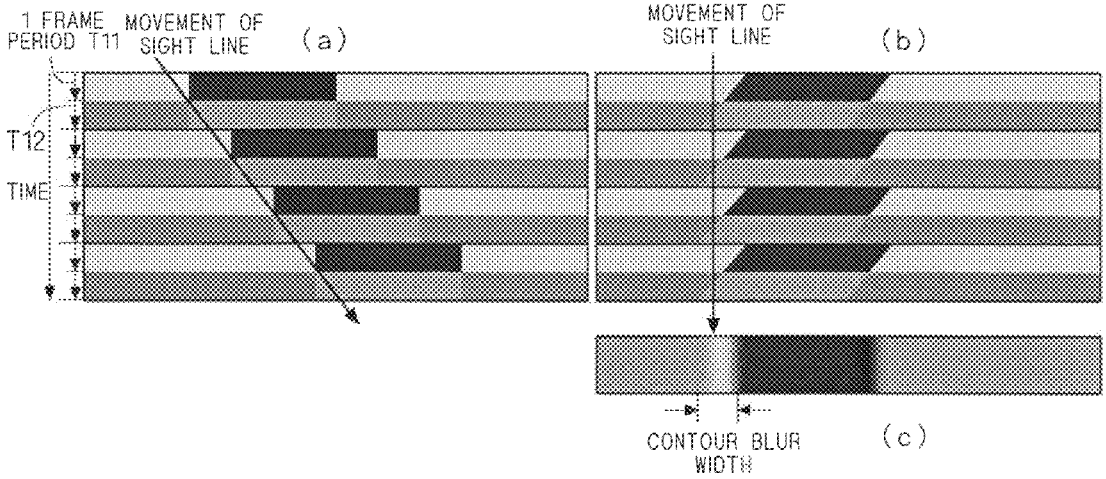
FIG. 14 is a diagram illustrating the display of a moving image in the liquid crystal display of the first preferred embodiment of the present invention.

FIG. 13 illustrates the variation of brightness on one horizontal line in the screen with the passage of time that is exhibited when only white and black are used as latter subframe data, and FIG. 14 illustrates the variation of brightness on one horizontal line in the screen with the passage of time that is exhibited when arbitrary brightness data pieces respectively close to the maximum output brightness data and the minimum output brightness data are used as latter subframe data.

In (a) and (b) portions of FIG. 13 and FIG. 14, the horizontal axis shows the state of brightness in the horizontal direction on the screen, and the vertical axis shows the passage of time, where one frame period T1 is divided into two subframe periods T11 and T12. Also, (c) portions of FIG. 13 and FIG. 14 show the distributions of brightness of the object viewed by a viewer viewing the moving object.

In FIG. 13, the latter subframes display white for the display of black of the background in the first subframes, and the latter subframes display black for the arbitrary brightness displayed for the moving object in the first subframes. In this case, as shown in (c) portion of FIG. 13, gradations occur at the contours of the moving object, and the state of blur in the direction of movement of the moving object and the state of blur in the opposite direction differ from each other. Also, the gradations include a portion that is too dark (dark line) and a portion that is too bright (bright line). This shows a result of processing based on the method disclosed in Patent Document 2 as shown in FIG. 5.

On the other hand, in FIG. 14, arbitrary brightness data close to the minimum output brightness is used in the latter subframes for the background of the first subframes, and arbitrary brightness data close to the maximum output brightness is used in the latter subframes for the black display of the moving object in the first subframes. In this case, as shown in (c) portion of FIG. 14, gradations occur at the contours of the moving object, but there is no significant difference between the state of blur in the direction of movement of the moving object and the state of blur in the opposite direction, with no dark line and no bright line.

Also, the reduction of brightness in the entire screen is suppressed by the use of arbitrary brightness data respectively close to the maximum output brightness data and the minimum output brightness data as latter subframe data, together with the maximum output brightness data and the minimum output brightness data.

Accordingly, there is no need to increase the backlight brightness to deal with the reduction of brightness, and so the power consumption is not increased and the black brightness is not increased.

Also, the conventional configuration can be used to obtain the effects above without a need to add special configuration to the liquid crystal display, and so the circuit scale is not enlarged. Also, there is no need for increased frame memory capacity and higher-speed communication with the frame memory, and so no cost increase is needed.

Also, the first subframe data is subjected to overdrive operation through the overdrive operation circuit 16, making it possible to compensate for the lack of liquid crystal response characteristic when the gray level varies from white/black data to halftone data.

<First Modification>

The above-described configuration of the liquid crystal display of the first preferred embodiment may additionally have a configuration that creates latter subframe data by predicting motion from the latter subframe data of the previous frame, instead of creating it only with the input data of the present frame.

That is, as described with FIGS. 6 and 7, when the gray level of the latter subframe data varies from a gray level of a minimum extreme value to a gray level of a maximum extreme value, or when the gray level varies in the opposite direction, a dark line and a bright line occur at the contours of the gray level variation. The occurrence of dark and bright lines can be suppressed by creating the latter subframe data by predicting motion from the latter subframe data of the previous frame, so that the latter subframe data can follow the moving object.

Figure 15:
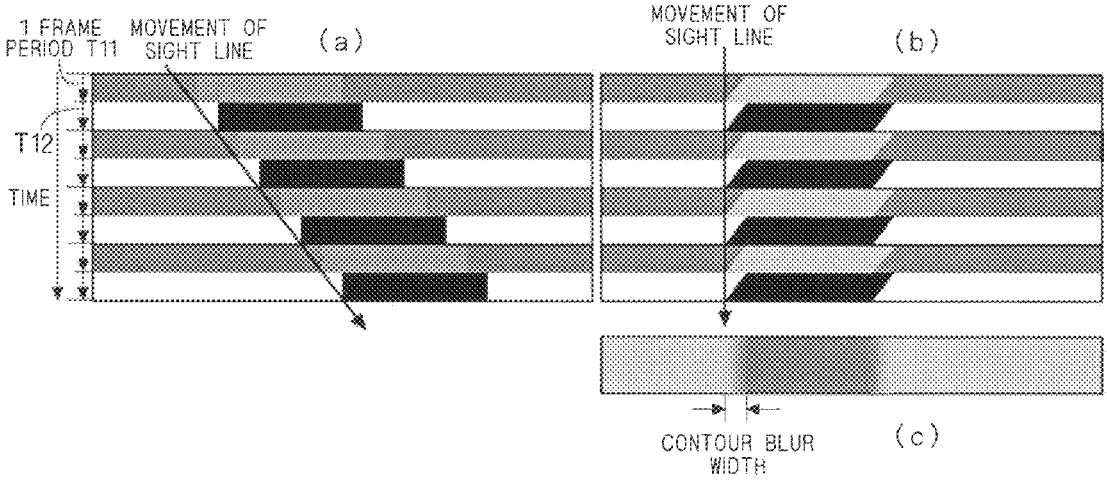
FIG. 15 is a diagram illustrating the display of a moving image in a liquid crystal display of a first modification of the first preferred embodiment of the present invention.

FIG. 15 illustrates the variation of brightness on one horizontal line in the screen with the passage of time that is exhibited when this scheme is adopted. In (a) and (b) portions of FIG. 15, the horizontal axis shows the state of brightness in the horizontal direction on the screen, and the vertical axis shows the passage of time, where one frame period T1 is divided into two subframe periods T11 and T12. Also, (c) portion of FIG. 15 shows the distribution of brightness of an object that is viewed by a viewer viewing a moving object.

As shown in (a) portion of FIG. 15, arbitrary brightness is displayed for the moving object in the first subframes and black is displayed in the latter subframes, and the moving object in the latter subframes somewhat leads ahead of the object in the first subframes, because the later subframes are created by predicting motion from the latter subframe data of the previous frames. Accordingly, as shown in (b) portion of FIG. 15, the viewer sees no shift of the position of the object in the first subframes and the latter subframes. As a result, as shown in (c) portion of FIG. 15, gradations occur at the contours of the moving object but the state of blur in the direction of movement of the moving object and the state of blur in the opposite direction do not significantly differ, with no dark line and no bright line.

A motion prediction circuit for the motion prediction can be provided such that it precedes the data parallel-serial converter 15 shown in FIG. 9, for example, and latter subframe data of the previous frame read from the frame memory 5 is given to the motion prediction circuit as shown in Step S10 of FIG. 12, for example.

In this case, the motion predicting processing can also be performed with 2-bit data, without the need for processing with the gray-level bits of the input data, and so the circuit scale of the motion prediction circuit can be small.

<Second Modification>

The above-described liquid crystal display of the first preferred embodiment is provided with the overdrive operation circuit 16 to compensate for the lack of liquid crystal response characteristic when the gray level varies from white/black data to halftone data, but the overdrive operation circuit 16 may be omitted when the liquid crystal panel has such a high-speed response characteristic that the liquid crystal response converges within subframes.

While the invention has been described in detail, the foregoing description is in all aspects illustrative and not restrictive. It is understood that numerous other modifications and variations can be devised without departing from the scope of the invention.

What is claimed is:

1. A liquid crystal display, comprising:

a liquid crystal panel;

a frame memory that stores, frame by frame, data displayed in the liquid crystal panel; and a controller that controls display in the liquid crystal panel on the basis of input frame data, the controller including a data converter that divides the input frame data into first subframe data and latter subframe data, and selects data for the latter subframe data from four pieces of data including maximum output brightness data, minimum output brightness data, and arbitrary first and second brightness data that are respectively close to the maximum output brightness data and the minimum output brightness data such that an average of integrated values of output brightness of the first subframe data and output brightness of the latter subframe data is equal to a target brightness of the input data, and a data serial-parallel converter that serial-parallel converts the latter subframe data, wherein the latter subframe data is stored in the frame memory, and the first subframe data controls the display in the liquid crystal panel together with the latter subframe data that is stored in the frame memory for one horizontal line that precedes a currently-processed one horizontal line by a predetermined number of lines.

2. The liquid crystal display according to claim 1, wherein the controller includes an overdrive operation circuit that applies an overdrive operation to the first subframe data, and the first subframe data is used to control the display in the liquid crystal panel after the overdrive operation.

3. The liquid crystal display according to claim 2, wherein the overdrive operation circuit performs the overdrive operation with latter subframe data for a same one horizontal line of a previous frame that is stored in the frame memory.

4. The liquid crystal display according to claim 1, wherein the maximum output brightness data, the minimum output brightness data, and the first and second brightness data that are included in the latter subframe data are stored in the frame memory as a 2-bit data value.

5. The liquid crystal display according to claim 1, wherein the predetermined number of lines is set by multiplying one frame period/one horizontal period by a predetermined coefficient, and the predetermined coefficient corresponds to a ratio of a display period of the first subframe data.

6. The liquid crystal display according to claim 1, wherein the maximum output brightness data, minimum output brightness data and arbitrary first and second brightness data each specify a particular gray level.

7. A controller for a liquid crystal display, comprising:

a data converter that divides input frame data into first subframe data and latter subframe data, and selects data for the latter subframe data from four pieces of data including maximum output brightness data, minimum output brightness data, and arbitrary first and second brightness data that are respectively close to the maximum output brightness data and the minimum output brightness data such that an average of integrated values of output brightness of the first subframe data and output brightness of the latter subframe data is equal to a target brightness of the input data; and a data serial-parallel converter that serial-parallel converts the latter subframe data, wherein latter subframe data is stored in a frame memory, and the first subframe data controls display in the liquid crystal panel together with the latter subframe data that is stored in the frame memory for one horizontal line that precedes a currently-processed one horizontal line by a predetermined number of lines.

8. The controller according to claim 7, wherein the latter subframe data is handled as a 2-bit data value.

* * * * *